United States Patent [19]

Okubo

[11] 4,193,532

[45] Mar. 18, 1980

[54] CONTAINER WITH AN INTERNAL DIVIDER

[75] Inventor: Hachiro Okubo, Osaka, Japan

[73] Assignee: Kinki Printing Company, Ltd., Osaka, Japan

[21] Appl. No.: 917,651

[22] Filed: Jun. 21, 1978

[51] Int. Cl.[2] ..... B65D 5/50

[52] U.S. Cl. ..... 229/28 R

[58] Field of Search ..... 229/27, 28 BC; 206/621

[56] References Cited

U.S. PATENT DOCUMENTS

| | | | |
|---|---|---|---|
| 1,991,425 | 2/1935 | Sherman | 229/28 R |
| 2,020,870 | 11/1935 | Benoit | 229/27 X |
| 2,346,206 | 4/1944 | Broderick | 229/27 |
| 2,426,865 | 9/1947 | Fink | 229/27 X |
| 2,732,994 | 1/1956 | Anderson, Jr. | 229/28 BC |
| 3,084,790 | 4/1963 | Vander Lugt, Jr. | 229/27 X |
| 3,244,349 | 4/1966 | Randles, Jr. | 229/28 R |
| 3,291,365 | 12/1966 | Koene | 229/28 R |
| 3,642,190 | 2/1972 | Glaser | 229/28 R |
| 3,958,748 | 5/1976 | Smith et al. | 206/621 |

*Primary Examiner*—Davis T. Moorhead

*Attorney, Agent, or Firm*—Wenderoth, Lind & Ponack

[57] ABSTRACT

The container of this invention has an internal divider which defines a plurality of compartments or recesses for receiving objects such as bottles or jars and keeping them separated from one another to prevent such articles from being broken by coming into contact with one another when the container is being transported or stored. The outer casing of the container also has a lid opening tongue which is integrally connected across a fold line with the central area of one end portion of a top panel or a front wall, and a sealing piece which is defined between a fold line and an arcuate score line.

2 Claims, 12 Drawing Figures

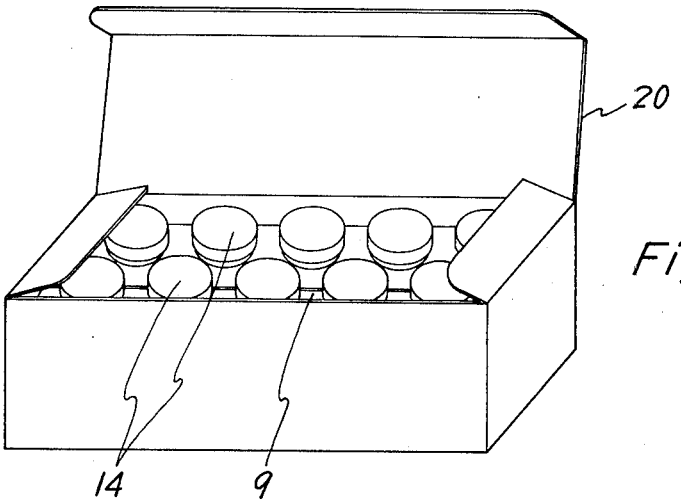
Fig. 1
Fig. 2
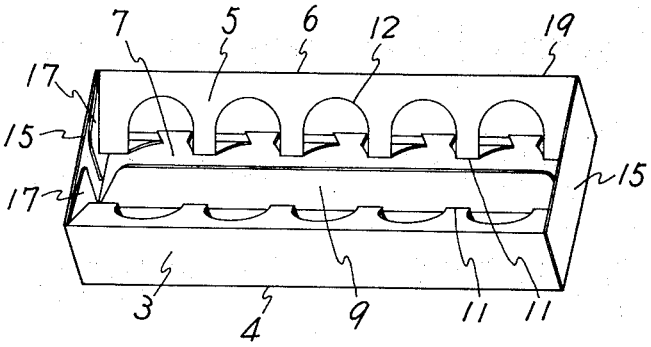
Fig. 3
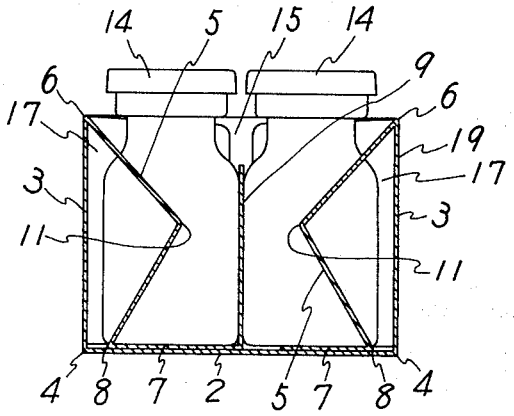

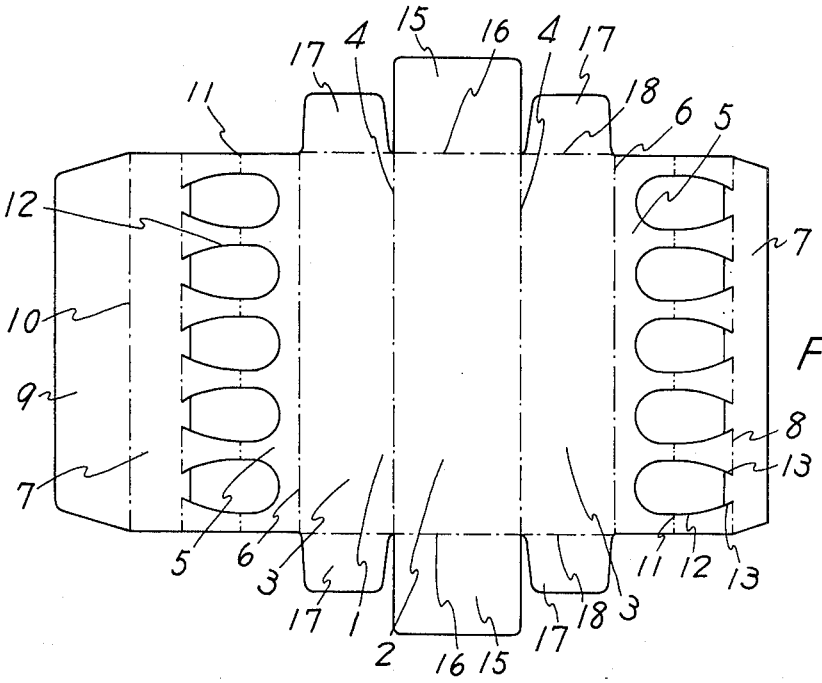
Fig. 4
Fig. 5
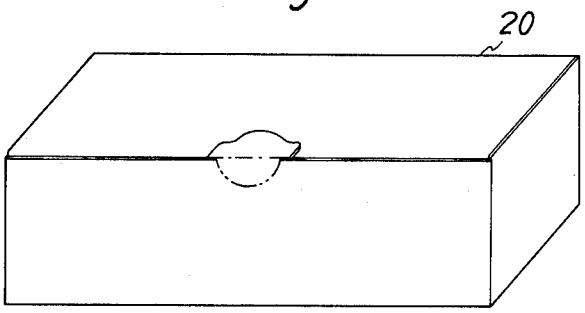
Fig. 6
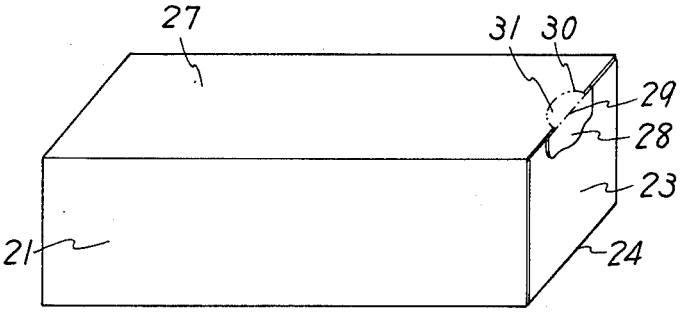

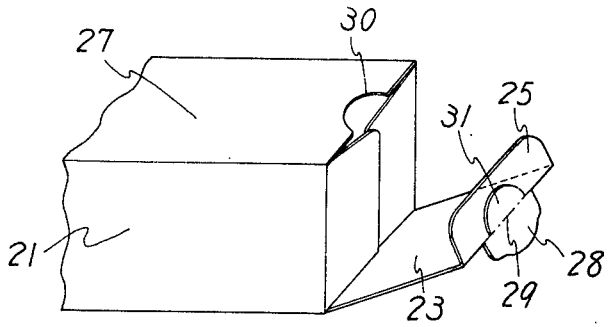
Fig. 7
Fig. 8
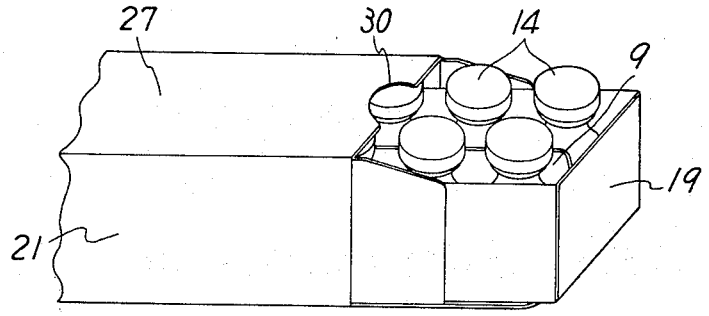
Fig. 9
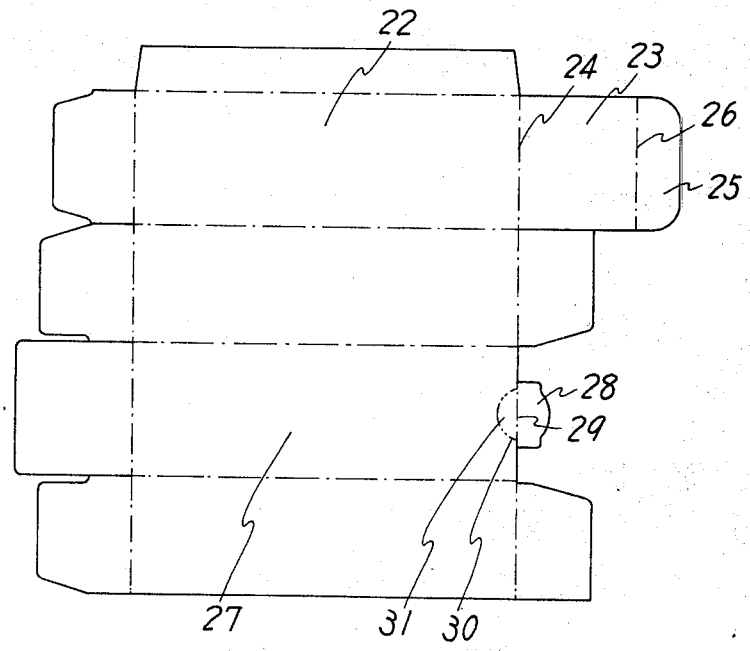

CONTAINER WITH AN INTERNAL DIVIDER

BACKGROUND OF THE INVENTION

This invention relates to a container for holding objects provided with an internal divider having inner side walls and a central dividing panel. The inner side walls engage each of the objects, such as bottles, in curvilinear contact so as to separate one object from the others; and the central dividing panel, together with the inner side walls, holds the outer surface of the objects firmly and immovably therein. Thus, the container of this invention can store or transport such objects as bottles quite safely without allowing them to come into contact with each other or to be broken.

SUMMARY OF THE INVENTION

It is an object of this invention to provide a container which is capable of holding objects firmly and not in contact with one another so that they can be stored or transported quite safely without being brought into contact with one another or broken.

According to the invention there is provided a container comprising an internal divider defining a plurality of compartments or recesses within the container the internal divider is formed from a blank of foldable sheet material such as cardboard folded along predetermined fold lines to form the internal divider.

BRIEF DESCRIPTION OF THE DRAWINGS

Various embodiments of the invention are described below with reference to the accompanying drawings in which:

FIG. 1 is an open perspective view of a top panel opening and closing-type container without a sealing piece, FIG. 2 is a perspective view of an insert which forms an internal divider in the container of FIG. 1, FIG. 3 is a longitudinal cross-sectional view of the insert with bottles fitted therein, FIG. 4 is a top plan view of a blank for the insert, FIG. 5 is a perspective view of a top panel opening and closing type container with a sealing piece, and shown with its lid closed, FIG. 6 is a perspective view of a side wall opening and closing type container with a sealing piece and shown with its lid closed, FIG. 7 is a perspective view of the container of FIG. 6 when the seal is removed and the lid is opened, FIG. 8 is a perspective view of the container of FIG. 6 with the insert partially withdrawn from the shell, FIG. 9 is a top plan view of the blank for the shell of the container shown in FIG. 6.

DETAILED DESCRIPTION OF THE INVENTION

Figure 10:
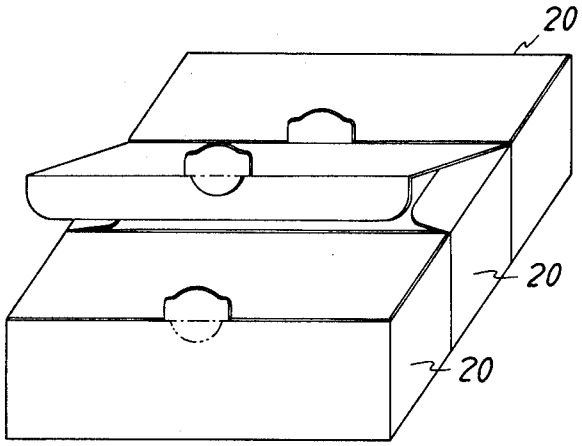
FIG. 10 is a perspective view of some containers such as shown in FIG. 5 when they are drawn up in a line with their tongue portions projecting upwardly.

The container to be described below is intended to contain a plurality of rather easily breakable glass bottles or jars with chemicals or the like therein in such a way that the bottles or jars are not brought into contact with one another and are not broken when the containers are being transported or stored.

Referring to FIG. 4 a blank 1 is divided by a pair of inner parallel longitudinal fold lines 4 and a parallel pair of outer longitudinal fold lines 6 into a bottom panel 2 which is provided in the central area, a pair of outer side walls 3, and a pair of inner side walls 5 which are a little wider than the outer side walls 3. A pair of glue flaps 7 are formed by folding the blank along longitudinal fold lines 8, the glue flaps being located at an angle, (see FIG. 3), formed by and attached to the inner side walls 5. Each of the glue flaps 7 is about one-half the size of the bottom panel 2. A central dividing panel 9 is integrally connected to one of the glue flaps 7 along a longitudinal fold line 10, i.e. the panel 9 is integral with flap 7 but is divided from the flap 7 by the fold line 10. A pair of longitudinal fold lines 11 run through the central parts of the inner side walls. The lines 4, 6, 8, 10 and 11 are, of course, all parallel to each other.

A plurality of pieces are cut out of the blank thereby creating holes 12 for placing bottles or other objects which are held firmly therein by the walls surrounding the holes. A series of resulting holes are arranged along each of the longitudinal fold lines 11 in each of the inner side walls 5. The inner side walls are bent in the form of the letter v at the longitudinal fold lines 11. The holes 12 are of any number with the walls bordering their middle areas being bent in such a manner as to form the letter v. A pair of discontinuous score lines 13 are scored from the portion nearest the nearer line 8, bordering each of the holes 12 to the respective nearer longitudinal fold line 8. End panels 15 are integrally connected to the bottom panel 2 along respective transverse fold lines 16. Two pairs of end glue flaps 17 are integrally connected the outer side walls 3 along respective pairs of transverse fold lines 18.

The blank of FIG. 4 is formed into a generally rectangular insert of the form shown in FIG. 2 as follows:

In forming the insert the end panels 15 are bent around transverse fold lines 16 so as to stand vertically, the end flaps 17 are bent upwardly about their fold lines 18, and the outer side walls 3 are bent at their respective longitudinal fold lines 4 so as to stand vertically, each end panel 15 envelopes and is, and glued to the outer surface of the glue flaps 17 at the respective longitudinal end of the insert. Thus the flaps 17, at each end extend towards each other. The inner side walls 5 are then bent towards each other, at longitudinal fold lines 6, the walls 5 being bent in a first direction at lines 11 and the blank being bent in a second direction at lines 10. The blank is thus folded into the form indicated in FIG. 3 in which flaps 7 face each other and touch the inner surface of the bottom panel 2. The glue flaps 7 are stuck to the inner surface of the bottom panel 2. The numeral 19 designates to the completed insert so formed and the numeral 9 to the longitudinal vertical dividing panel standing vertically from the bottom panel 2 and formed by panel 9.

As shown in FIG. 3, the inner side walls 5 of the slide 19 are bent in the form of the letter v at the respective longitudinal fold lines 11 to provide opposing ridges in which, when the formed blank is viewed in plan, the holes 12 are semi-circular notches defined by edges which are generally semi-circular, said edges engaging the circumference of the respective jars 14.

The central dividing panel 9 stands between the two opposing groups of holes 12. Thus, when the contents 14 are inserted from the top into the recesses defined by the edges of the holes 12 and the panel 9, portions of the inner side walls 5 lie between every jar and the adjoining jars 14 to prevent them from being brought into contact with each other, and also a central dividing panel 9 stands between the two opposing groups of jars 14 to separate one group from the other group. Thus, each of the jars 14 is perfectly protected.

In other words, when the contents 14 such as bottles or jars are placed from the top into the holes 12, the outer side of each of the contents 14 is in contact with a curved edge of each hole 12 while its inner side is in contact with a corresponding part of the central dividing panel 9. Thus, the contents are firmly held by the walls of the holes 12 and the panel 9, and are perfectly protected with each of the contents 14 being separated from its neighboring contents 14.

The insert described is fitted within a rectangular box shell which may be as shown in FIG. 5, or as shown in FIG. 6.

In FIGS. 1 and 5, the numeral 20 designates a top panel opening and closing type shell, in FIGS. 6 to 8, numeral 21 designates a side wall opening and closing type shell.

The shell 21 is formed from a blank as shown in FIG. 9. The numeral 22 designates a bottom panel of the shell 21 provided by this blank. Lid panels 23 of this blank are integrally connected across fold lines 24 to both ends of the bottom panel 22. An insertion flap 25 is integrally connected across a fold line 26 to one of the lid panels 23 in this blank. The part designated by numeral 27 is a top panel of the shell 21. A lid opening tongue 28 is provided as an integral portion of top panel 27 and centrally located across a fold line 29. The numeral 30 designates an arcuate score line, or alternatively a line of perforation connected to the ends of the fold line 29. A sealing piece 31 is defined between the fold line 29 and the arcuate score line 30. The manner in which the blank of FIG. 9 is folded, at the fold lines indicated by chain-dotted lines, to form the sleeve 21, will be evident to one skilled in the art upon viewing FIGS. 6 to 8.

In the case of the top panel opening and closing type shell 20, the top of the insert 19 with the dividing panel 9 can be seen when the lid is open so that its contents may be taken out. In the case of the side wall opening and closing type shell 21, after opening the lid 23, the insert 19 is withdrawn by sliding longitudinally from the shell 21 to an extent necessary to allow the contents, such as jars 14 to be taken from the slide and used.

In closing and sealing the side wall opening and closing type shell, the insertion flap 25 at the edge of the lid panel 23 is inserted beneath the top panel 27 (as viewed in FIG. 7) above the adjoining upper edges of the respective side flaps and above the insert 19 in such a way that the flap 25 and panel 27 lie against each other and the sealing piece 31 provided at one edge of the top panel 27 is stuck to the upper surface of the insertion flap 25. The lid cannot be opened unless the piece 31 is separated from the panel 27 along the circular score line 30.

In opening the side wall opening and closing type shell, the circular score line 30 is pressed and broken with the tip of a finger, and the lid opening tongue 28 is held with the fingers and pulled. This breaks the connection between the top panel 27 and the inserting piece 25 of the lid panel 23. Thus, as shown in FIG. 7, the sealing piece 31 is separated from the panel 27 along the circular score line 30, and the lid is easily opened.

After the contents have been taken out, the lid can easily be closed again by inserting the insertion flap 25 again below the top panel 27 in such a way that the flap 25 and panel 27 lie against each other.

The top panel opening and closing type shell 20 is provided with a sealing piece and lid opening tongue in exactly the same way as in the shell 21 except that the sealing piece and lid opening tongue are initially an integral portion of the front wall and the sealing piece is stuck to the insertion flap at the free front edge of the top panel which is flexibly connected at its opposite back edge to the back wall of the shell.

In the case of the top panel opening and closing type shell 20, the insert 19 can be seen when the lid is open. Thus, it is possible not only to take out the contents but also to close the lid without requiring sliding movement of the insert.

Even when a plurality of the shells 20, once opened and thereafter closed, are put side by side, it is possible to open the lid of a shell placed in the middle by allowing its lid opening tongue 28 to stand up, as shown in FIG. 10, and then by pulling it up.

Figure 11:
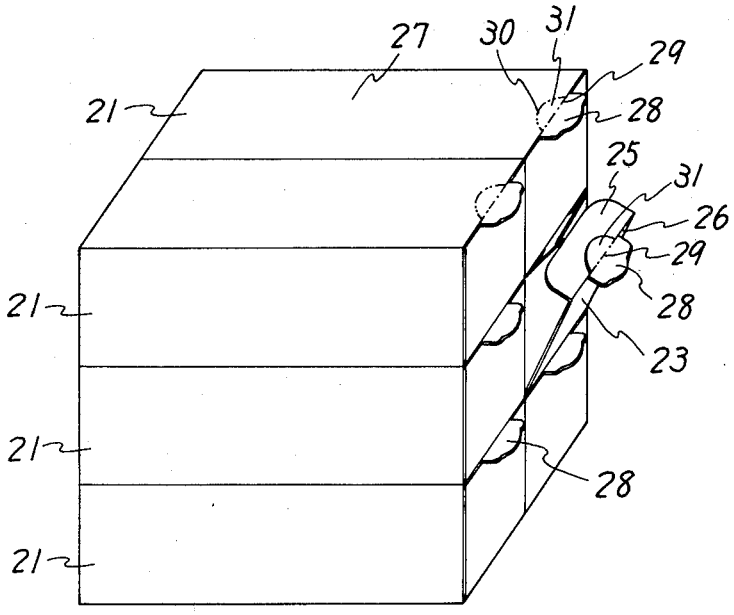
FIG. 11 is a perspective view of some shells such as shown in FIG. 6 when they are placed one on top of another with their tongue portions projecting forward.
Figure 12:
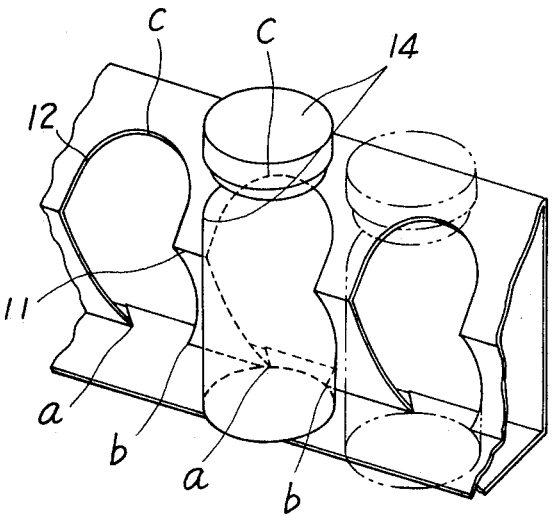
FIG. 12 shows a perspective view of the insert with the bottles in position.

Even when a plurality of the side wall opening and closing type shell 21, once opened and thereafter closed, are placed on top of each other, it is possible to open the lid of any shell quite easily as shown in FIG. 11.

What I claim is:

1. A container with a dividing device formed from a single bent blank, comprising:

(a) flat central dividing means;

(b) v-shaped inner side walls, said side walls having openings therein for holding objects such as bottles, said side walls being positioned with their apexes opposed to each other and the edges of said side walls spaced from said flat central dividing means for holding said objects firmly between said side walls and said central dividing means; and (c) an outer casing in which said bent blank is positioned.

2. A container as defined in claim 1 wherein said outer casing is a top panel opening and closing type shell further comprising: a lid opening tongue integrally connected at a fold line to the central area of a front portion of said top panel of said shell; an insertion flap attached to said top panel;

an arcuate score line connecting the ends of the aforementioned fold line and said score line located on a front wall which is adjacent to said top panel and said lid opening tongue; and a sealing piece defined by the area of said front wall bounded by said arcuate score line and said fold line, said arcuate shaped sealing piece being attached to the outer surface of said insertion flap of said top panel.

* * * * *